US005165940A

United States Patent [19]

Windley

[11] Patent Number: 5,165,940

[45] Date of Patent: Nov. 24, 1992

[54] SPINNERET

[75] Inventor: William T. Windley, Seaford, Del.

[73] Assignee: E. I. du Pont de Nemours and Company, Wilmington, Del.

[21] Appl. No.: 876,724

[22] Filed: Apr. 23, 1992

[51] Int. Cl.[5] ..... B29C 47/30; B29C 47/88

[52] U.S. Cl. ..... 425/72.2; 65/12; 264/12; 264/211.14; 425/192 S; 425/378.2; 425/461; 425/463

[58] Field of Search ..... 425/72.1, 72.2, 192 S, 425/461, 463, 464, DIG. 236, 378.2, 7; 264/211.12, 211.14, 211.13, 176.1, 12; 65/12, 14, 16

[56] References Cited

U.S. PATENT DOCUMENTS

| | | | |
|---|---|---|---|
| 3,465,618 | 9/1969 | McIntosh et al. | 425/72.2 |
| 3,543,332 | 12/1970 | Wagner et al. | 425/72.2 |
| 3,802,817 | 4/1974 | Matsuki et al. | 425/66 |
| 3,825,380 | 7/1974 | Harding et al. | 425/72 |
| 3,920,362 | 11/1975 | Bradt | 425/72 |
| 3,954,361 | 5/1976 | Page | 425/72 S |
| 4,124,666 | 11/1978 | Wilhelm et al. | 264/39 |
| 4,204,828 | 5/1980 | Peckinpaugh et al. | 425/72 S |
| 4,316,716 | 2/1982 | Lin | 425/72 S |
| 4,988,464 | 1/1991 | Riley | 425/7 |

FOREIGN PATENT DOCUMENTS

| | | | |
|---|---|---|---|
| 47-36207 | 9/1972 | Japan | 425/72.2 |
| 274190 | 7/1951 | Switzerland | 425/72.2 |

*Primary Examiner*—Jay H. Woo
*Assistant Examiner*—Khanh P. Nguyen

[57] ABSTRACT

High twist fibers are produced in a spin/quench/twist process directly from a modified spinneret. The spinneret consists of capillaries that are installed in highly elongated inserts which are surrounded by heat deflecting shields surrounded by an annular concentric orifice supplied with a fluid (air or steam preferred) that simultaneously quenches and twists the emerging filaments as they exit the capillary quench/torque jet.

3 Claims, 1 Drawing Sheet

SPINNERET

BACKGROUND OF THE INVENTION

The invention relates to melt spinning synthetic filaments and, more particularly, it relates to spinnerets for extruding, quenching and twisting such filaments.

U.S. Pat. No. 3,920,362 discloses a fiber spinning apparatus wherein synthetic filaments are extruded from an internal needle-like capillary which is shown to have individual twisting orifices surrounding the outside of the capillary housing in addition to a primary orifice that supplies fluid for advancing and blowing out the filaments from within the assembly. Needle-like capillaries are complex, susceptible to plugging, and difficult to clear.

SUMMARY OF THE INVENTION

A more efficient, less complex spinneret has now been produced for quenching and twisting filaments as they are being spun. The spinneret comprises a plate having upper and lower surfaces connected by a hole having a cone-shaped wall portion exiting the lower surface of the plate. An assembly is located concentrically within and spaced from the wall of the hole to form a first annular passage. The assembly is positioned flush with the lower surface of the plate and includes a first tube concentrically surrounding and spaced from a second tube to form a second annular passage. The second tube has a central axial passage through which molten polymer passes to form an extruded filament and means are provided for supplying pressurized fluid to the first annular passage. The cone-shaped wall portion of the hole through the plate has an included angle of from about 30 degrees to about 90 degrees. The first and second tubes in the proximity of the lower surface have the same conicity as the cone-shaped walls of the hole.

Filaments of greater than 2,000 denier and other filaments with twist levels up to 500 turns per inch (197 turns/cm) are capable of being produced with this spinneret.

The high twist is a very effective crimp substitute requiring much less energy than conventional texturing processes. Fiber from the process can be deposited directly onto a belt for spun-bonded fabrics with high loft or can be collected by an air sucker jet as individual fibers or wound up as continuous multifilament yarns. Melt-spun twisted fibers of nylon, polypropylene, polyester, and polyethylene are considered preferred products of the invention.

DETAILED DESCRIPTION OF THE PREFERRED EMBODIMENT

Figure 2:
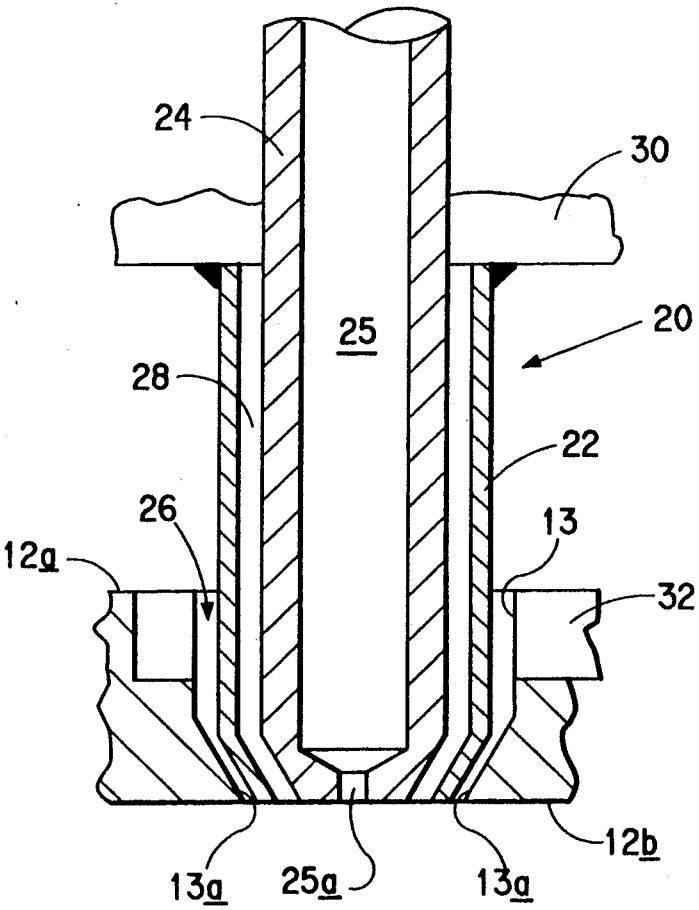
FIG. 2 is an enlarged view of some of the elements of the spinneret shown in FIG. 1.
Figure 1:
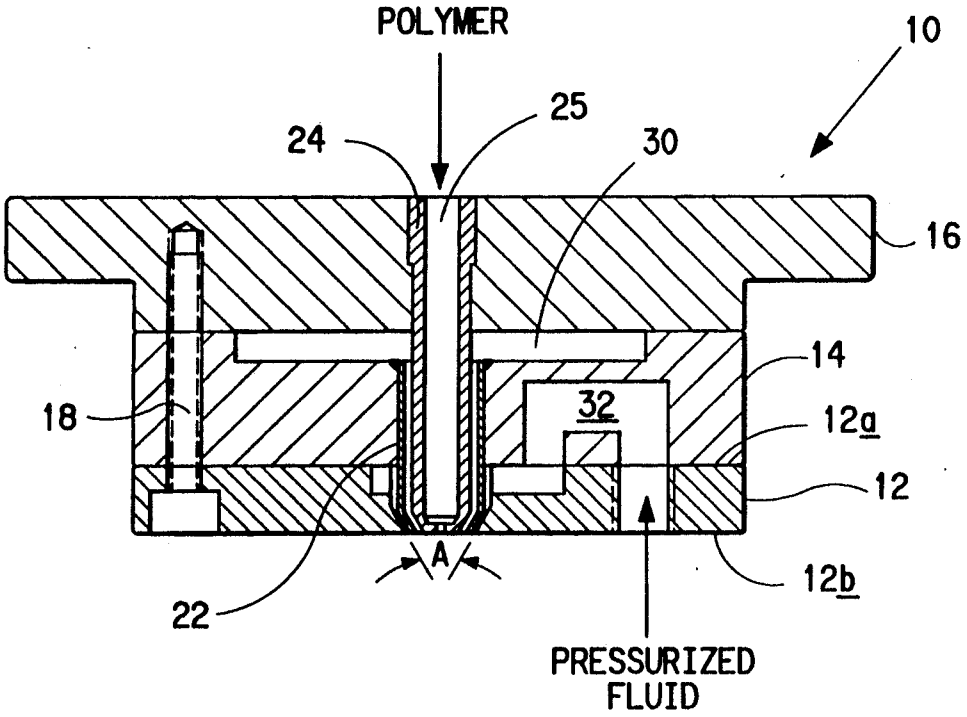
FIG. 1 is an elevation view of a single hole spinneret of the present invention.

The embodiment chosen for purposes of illustration is shown in FIGS. 1 and 2 wherein the spinneret 10 is assembled from three plates 12, 14 and 16 held together by bolts 18 (only one of which is shown). The plate 12 has upper and lower surfaces 12*a* and 12*b*, respectively, connected by a hole 13 having a cone shaped wall portion 13*a* exiting the lower surface 12*b* of plate 12. An assembly 20, comprising a first tube 22 concentrically surrounding and spaced from a second tube 24 with a central axial passage 25, is concentrically located in hole 13 flush with the bottom surface 12*a* of plate 12 and spaced from the wall of the hole to form a first annular passage 28. The axial passage 25 exits the lower end of tube 24 as a capillary 25*a*. The space between tube 22 and 24 forms a second annular orifice 28. A recess is provided in plate 14 that forms a dead air space 30 between plates 14 and 16. The annular passage 28 is in communication with the dead air space 30. A passage 32 for pressurized fluid is formed in plates 12 and 14 and is in communication with the first annular passage 26 and, as shown in FIG. 1, means are provided to introduce fluid under pressure through the bottom surface 12*b* of plate 12 into passage 32. The first tube 22 and the second tube 24 in the proximity of the lower surface 12*b* have substantially the same conicity as the cone-shaped wall portion 13*a* of hole 13. The cone-shaped wall portion 13*a* of hole 13 has an included angle A of from about 30 to about 90 degrees.

In operation, molten polymer is pumped through passage 25 and is extruded through capillary 25*a* as a filament. Pressurized cooling fluid is supplied to passage 32 and flows through the first annular passage 26 and is distributed around the filament extruded from the capillary 25*a* at the lower surface 12*b* of plate 12. The second annular passage 28 provides a dead air space around tube 24 to provide insulation around the tube from the effects of the cooling fluid flowing out annular passage 26.

The spinneret of this invention is suitable for high throughput production of twisted continuous multifilaments, monofilaments or discontinuous fibers. Subdenier filaments as well as filaments having deniers in the thousands may be spun using the spinneret of this invention. With increased air flow three dimensional crimp has been generated by the overtwisting action of the fibers at a point between 0.5 and 30 inches below the spinneret. Air impingement angles (total conical included angle A) of 30 to 90 degrees produce stable quench/twisting. With 60 and 90 degree impingement angles the yarn fluid interaction moves closer to the capillary, quenching air flow is reduced, and downward air flow is reduced. Sonic air velocity is not required for effective cooling. Experiments show that free falling puddles of polymer on the floor extruding at 30 grams/minute are converted to attractive filaments when 2–3 psig ambient temperature air is supplied to the annular passage 26. Passage widths of 0.01–0.15 mm are preferred. The smaller annular passage widths are preferable since they produce a high velocity air jet with less air consumption than larger widths.

The spinneret of the invention can be supplied with saturated or superheated steam if desired for more effective crimping to increase dye rate of the fiber, to stabilize filament shrinkage, or to prevent oxidation degradation of monomer deposits on the face of the capillary 25*a*. With the present invention, chemical applications can be accomplished including addition of antisoiling finishes, stainblockers, dyes, or dye modifiers by injection of the desired compositions into the pressurized fluid supply. The invention is not limited to the spinning of filaments but may be of use in the production of other extruded materials such as pipe, wire covering, fiberglass filaments and the like where rapid convective cooling is required.

EXAMPLE

In a series of runs, nylon 66 flake having a relative viscosity of 43 was spun at 295° C. from a spinneret as shown in FIG. 2. The type fluid and pressure supplied to the spinneret passage 32, the polymer throughput, filament denier, take-up speed and twist level are shown for each run in the following table.

TABLE

| Run No. | Fluid Type | Fluid Pressure (psig) | Polymer Throughput (GHS/min.) | Take-up Speed (M/min.) | Filament Denier | Filament Twist (Turns/cm) |
|---|---|---|---|---|---|---|
| 1 | Air | 15 | 9.8 | 35.1 | 2510 | 2.51 |
| 2 | Air | 15 | 9.8 | 572.0 | 154 | 8.66 |
| 3 | Air | 15 | 9.8 | 2097.0 | 42 | 65.35 |
| 4 | Steam | 9 | 14.0 | 68.7 | 1834 | 1.3 |
| 5 | Air | — | 9.8 | 6945.0 | 12.7 | — |

What is claimed is:

1. A spinneret for melt spinning and quenching synthetic filaments comprising: a plate having upper and lower surfaces connected by a hole having a cone-shaped wall portion exiting said lower surface; an assembly located in said hole flush with said lower surface and concentrically spaced from said cone-shaped wall portion to form a first annular passage; said assembly comprising a first tube concentrically surrounding and spaced from a second tube to form a second annular passage, said second tube having a central axial passage through which molten polymer passes; and means for supplying fluid under pressure to said first annular passage.

2. The spinneret of claim 1 wherein said first tube and said second tube in the proximity of the lower surface have substantially the same conicity as the cone-shaped wall of the hole.

3. The spinneret of claims 1 or 2 wherein said cone-shaped wall portion of said hole has an included angle of from about 30 to about 90 degrees.

* * * * *